US007223126B2

(12) United States Patent
Ng

(10) Patent No.: US 7,223,126 B2
(45) Date of Patent: May 29, 2007

(54) PLUG DEVICE WITH A PLUG ADAPTER

(75) Inventor: Yuk Hung Ng, Hong Kong (CN)

(73) Assignee: Helms-Man Industrial Co., Ltd., Hong Kong (CN)

( * ) Notice: Subject to any disclaimer, the term of this patent is extended or adjusted under 35 U.S.C. 154(b) by 0 days.

(21) Appl. No.: 10/849,112

(22) Filed: May 20, 2004

(65) Prior Publication Data

US 2005/0042929 A1 Feb. 24, 2005

(30) Foreign Application Priority Data

Aug. 21, 2003 (EP) ..... 03018962

(51) Int. Cl.
*H01R 25/00* (2006.01)

(52) U.S. Cl. ..... 439/651; 439/357

(58) Field of Classification Search ..... 439/651, 439/170–177, 372, 518, 680, 347, 956, 217, 439/166, 218, 311–314, 353, 354, 357
See application file for complete search history.

(56) References Cited

U.S. PATENT DOCUMENTS 4,736,177 A * 4/1988 Vollmer et al. ..... 335/299
5,613,863 A 3/1997 Klaus et al.
5,634,806 A * 6/1997 Hahn ..... 439/173
5,973,948 A * 10/1999 Hahn et al. ..... 363/146
5,998,964 A 12/1999 Martensson
6,086,395 A * 7/2000 Lloyd et al. ..... 439/172
6,109,977 A * 8/2000 Baxter et al. ..... 439/693
6,227,888 B1 5/2001 Hahn
6,261,109 B1 7/2001 Liu et al.
6,328,581 B1 * 12/2001 Lee et al. ..... 439/106
6,544,051 B1 * 4/2003 Su ..... 439/131
6,638,113 B2 * 10/2003 Kajiwara et al. ..... 439/651
6,669,495 B2 * 12/2003 Philips et al. ..... 439/170
2002/0055288 A1 5/2002 Philips et al.

FOREIGN PATENT DOCUMENTS

GB 2 331 187 A 5/1999

* cited by examiner

*Primary Examiner*—P. Austin Bradley
*Assistant Examiner*—Edwin A. Leon
(74) *Attorney, Agent, or Firm*—Browdy and Neimark, PLLC

(57) ABSTRACT

A plug device for fitting into a country specific electrical wall socket comprises a base part and at least one country specific electrical plug adapter, able to be secured to the base part, for fitting into the country specific line socket. The at least one plug adapter may be locked without using tools in an assembled state with a locking means and released from the base part after unlocking the locking means.

17 Claims, 2 Drawing Sheets

PLUG DEVICE WITH A PLUG ADAPTER

BACKGROUND OF THE INVENTION

The invention relates to a plug device for plugging into a country specific electrical plug receiving socket comprising a base part and at least one country specific electrical plug adapter, adapted to be secured to the base part, for insertion of the plug device into the country specific line socket.

THE PRIOR ART

In the case of base part it is for example a question of a power supply adapter or the like, which by means of the country specific electrical plug adapter may be connected with distinct country specific line socket outlets, which for instance are different in the USA, in Europe, in Australia or in the United Kingdom. The known country specific plug adapters have country specific characteristics both on the input side and also on the output side: for example a plug adapter for use in the USA may have a base part with a European plug plugged into it in order to provide adaptation to a line socket in the USA. Alternatively for example a plug adapter may be plugged to the base part, such plug adapter having European sockets on the input side and typical Australian plug contacts on the output side.

When the known combination, which is loosely plugged together of a base part and a plug adapter is removed from a country specific electrical line socket, then frequently the base part is detached from the plug adapter and the plug adapter must be separately removed from the plug receiving socket, which is frequently mounted in the wall. The known combination of a base part and a plug adapter requires, owing to the plugging together of a plurality of country specific plug-socket combinations, a comparatively large amount of space.

Another set of problems arises for the manufacture of plug devices. For different markets, in which respectively country specific, mutually different plug receiving sockets are conventional, it is necessary for different plug device to be manufactured, which for example have different plug contacts for the USA to those in Europe. The manufacture of different plug devices is however complex and comparatively expensive, more particularly in the case of small batches.

SHORT SUMMARY OF THE INVENTION

One object of the invention is accordingly to design a plug device of the type initially mentioned to have a simple and readily operated adaptation to different country specific line sockets.

In order to achieve the object in the case of a plug device of the type initially mentioned there is a provision such that the at least one plug adapter may be locked without using a tool (by hand) in a mounted position with one or more locking means and may be detached from the base part after unlocking the locking means.

The plug adapter is able to be simply mounted on the base part and owing to the locking by means of the locking means constitutes a compact structural unit reliably connected with the base part. Following unlocking of the locking means the plug adapter may be removed readily from the base part. Then it is possible to attach a different plug adapter suitable for other country specific conditions to the base part. A plug device in accordance with the invention may have a plurality of country specific plug adapters so that an adaptation of the plug device to country specific line sockets is readily possible without any complications.

Further advantageous developments of the invention are defined in the claims and indicated in the description.

Preferably the at least one plug adapter is able to be plugged to the base part. Alternatively a screw connection would be possible. In the case of the advantageous plugging technology the base part preferably possesses a plug socket for the plug adapter. Preferably, a plug projection is provided on the plug adapter, which in the mounted state fits into the plug socket.

The following measure contributes to the mechanical coherence of the combination comprising the base part and the plug adapter. The plug adapter is in the mounted state essentially not able to be tilted athwart the direction of insertion. This is for example made possible if the plug adapter is fitted deeply into the plug socket and/or ample engagement faces are present for the plug adapter within the line socket and/or at its edge regions. Moreover, guide means, to be explained in the following are provided contributing to providing stability as regards tilting. The locking means for locking the plug adapter must also, in this form of the invention, act essentially oppositely to the insertion direction, while on the contrary a stabilization athwart the insertion direction is less important. The mechanical load on the locking means is reduced as a result. The locking means may be designed to be compact and/or readily operated.

The locking means advantageously has at least one detent projection for fitting into a detent socket. The detent projection may for example be arranged on the plug adapter and the detent socket may be arranged on the base part or the other way round. The detent projection and/or a detent socket may be arranged on a resilient actuating element. By actuation of the actuating element the detent projection and the cooperating detent socket are disengaged so that the plug adapter is able to be detached from the base part. On plugging the plug adapter to the base part the resilient actuating element is advantageously automatically disengaged in order, on arriving in the mounted state, automatically spring back so that the detent projection and the detent socket engage again. The actuating element conveniently projects, at least partly, during non-operation past the outer face of the base part and/or the plug adapter. By pressing on the actuating element so that it advantageously essentially moves behind the outer face of the base part or, respectively, of the plug adapter, the plug adapter is unlocked. It is an advantage for the actuating stroke of the actuating element to be so large that accidental operation is prevented.

Preferably one single locking means is present. However, a plurality of locking means may be present and for example two locking means may be present on mutually opposite sides of the plug socket or four locking means may be present on each side of a rectangular plug socket.

For the electrical connection of the plug socket with the base part it is an advantage to have electrical plug contacts at the plug socket of the base part, such contacts not projecting past the plug socket and fitting into the plug receiving sockets of the plug adapter in the mounted condition. Accordingly the plug contacts are protected from mechanical damage.

The plug contact may be optimally adapted to existing electrical features. The plug contacts are preferably proprietary contacts and not common to country specific plugs. For instance, the plug contacts may be thinner than country specific plugs and be electrically conductive or the like along their complete length.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES

DETAILED ACCOUNT OF WORKING EMBODIMENT OF THE INVENTION

Figure 1:
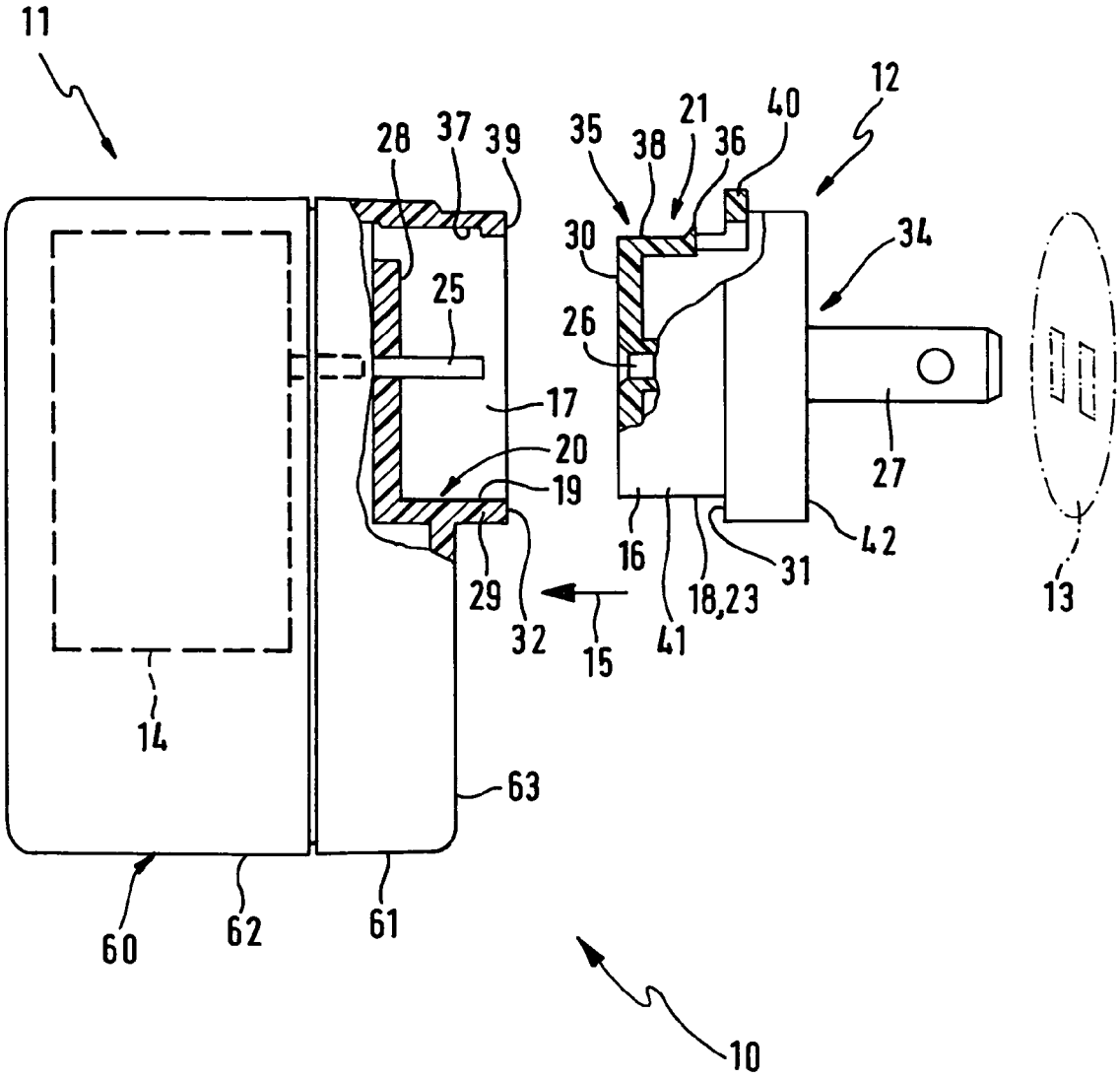
FIG. 1 shows a partly sectioned side view of a plug device in accordance with the invention having a country specific plug adapter customized for the USA.

In the case of the plug device 10 illustrated in FIG. 1 a country specific electrical plug adapter 12 is able to be joined by plugging with a base part 11 so that the plug device may be plugged into a country specific electrical plug receiving wall socket 13. The base part 11 can comprise an electrical device 14, as for example an electric lamp, a power pack, a charging device for accumulators or the like. The electrical device 14 may be for example a transformer, an inverter, a rectifier or some electrical adaptation means. The electrical device 14 may operate linearly or with a switching effect. The plug device 10 or respectively the base part 11 are in the present case portable. However in principle designs for stationary and non-portable applications are possible.

On the front top region of the base part 11 a plug socket 17 is arranged, into which the plug adapter 12 is able to be plugged. The base part 11 has a housing 60, for example of plastic, with a front and rear part 61 and 62. In the interior of the housing 60 the electrical device 14 is arranged. The plug socket 17 constitutes an integral component of the front part 61. The plug socket 17 is arranged in the front, top region of the front part 61. Side walls 29 and a floor side 28 of the plug socket 17 are formed by the front part 61 of the housing 60. The side walls partly project past the front side 63 of the front part 61. The floor side 28 is on the contrary set back in relation to a front side 63 of the front part 61.

The plug adapter 12 is able to be joined by plugging with the base part 11 and in the present case plugged into it. In the mounted state the plug adapter 12 covers over the plug socket 17. The fitting together of the plug adapter 12 is extremely simple. The plug adapter 12 is moved in a plugging direction 15 toward the base part 11 until a plug projection of the rear side of the plug adapter 12 fits into a plug socket 17 on the front side of the base part 11. The internal shape of the plug socket 17 corresponds to the outer shape of the plug projection 16. The plug projection 16 has, for example, a rectangular outline and the plug socket 17 has a corresponding rectangular inner shape. It will be clear that shapes other than rectangular outer shapes and corresponding inner shapes are possible, as for example circular or elliptical shapes.

Figure 2:
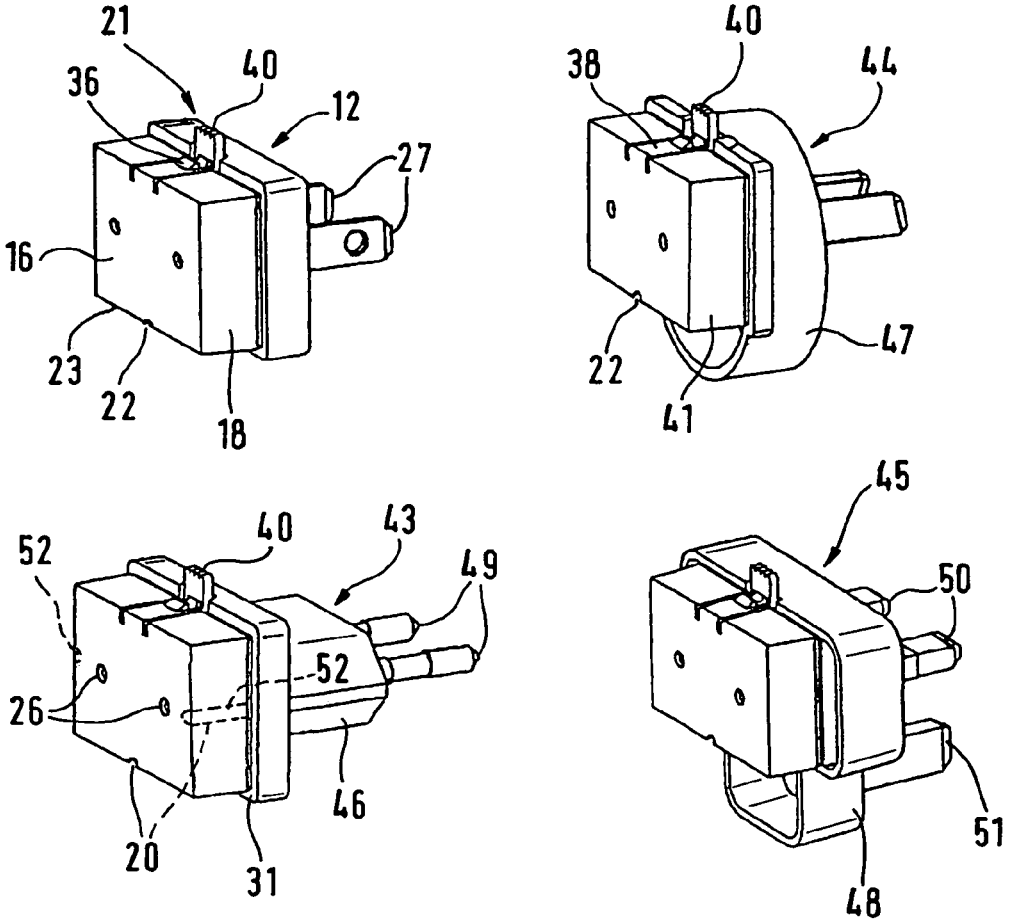
FIG. 2 shows the plug adapter as in FIG. 1 and further country specific plug adapters, which are able to be joined by plugging with a base part different to that of FIG. 1 but otherwise essentially similar to it.
Figure 2:
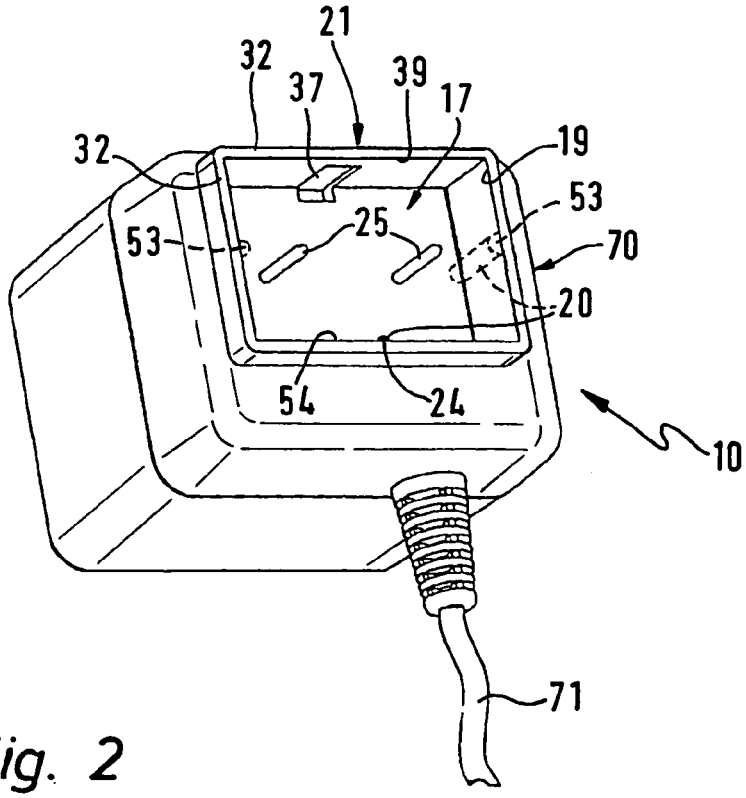

On introduction into the plug socket 17 sides faces 18 on the plug projection 16 slide along inner side faces 19 of the plug socket 17. Accordingly the side faces 18 and 19 constitute guide means 20 for angularly aligned guidance of the plug adapter 12 in the assembled position. In the working embodiment this is only possible in one single angular position, in the case of which a locking means 21 for locking the plug adapter 12 on the base part 11 is at the top as illustrated in the drawing. As shown in FIG. 2, this angular position is for example set by a guide projection 24 on the bottom inner face 54 of the plug socket, which fits into a guide groove 22 on the bottom side of the plug projection 16, in the present case on a bottom side face 23 on the plug projection 16. The guide groove 22 and the guide projection 24 also constitute guide means 20.

The guide means 20 in conjunction with a set back arrangement of plug contacts 23 at the plug socket 17 are responsible for ensuring that on insertion into the plug socket 17 the plug adapter 12 is moved into a particular angular position even prior to the fitting of the plug contacts 25 into the plug receiving sockets 26 of the plug adapter 12, in which position the plug contacts 25 are opposite to the plug receiving sockets 26 and may fit into the same. The mechanical load on the plug contacts 25 and, respectively, the plug receiving sockets 26 is accordingly small. The plug receiving sockets 26 are integrated in the plug adapter 12.

The plug contacts 25 and the plug receiving sockets 26 constitute an electrical connection between the base part 11 and the plug adapter 12. The electrical plug contacts 25 are connected electrically with the electrical device 14. In the assembled state therefore country specific electrical plug contacts 27, which project forward past the plug adapter 12, are electrically connected with the device 14.

The plug contacts 25 project perpendicularly to the front of the bottom side 28 of the plug socket 17. The plug contacts 25 however do not project past the plug socket 17. The plug contacts 25 are shorter than the side walls 29 of the plug socket 17 so that same are protected against mechanical damage by the side walls. This measure furthermore means that on insertion of the plug adapter 12 into the base part 11 firstly the outer side faces 18 of the plug projection 16 are guided into the predetermined angular position by the inner side faces 19 of the side walls 29.

The plug receiving sockets 26 of the plug adapter 12 may, as in the working example, be funnel-like and flared outwards toward the insertion side so that the plug contacts 25 may be more readily fitted into the plug receiving sockets 26.

When the plug projection 16 is completely fitted into the plug socket 17, the front side 30 of the plug projection 16 will abut the floor side 28. In the present case the sides 28 and 30 have their faces resting against each other over large areas in the assembled state of the plug adapter 12. Furthermore the side faces 18 and 19 lie against each other over large areas and the guide projection 24 fits into the guide groove 22 so that generally there is a firm engagement of the plug adapter 12 with the base part. This firm connection of the plug adapter 12 with the base part 11 is also ensured by the fact that in the assembled state a lateral projection 31 on the plug adapter 12 engages terminal sides 32 of the side walls 29 of the plug socket 17 essentially over a large flat area. The lateral, in the present case peripheral, projection 31 is for example like a collar. The lateral projection 31 is constituted by a front region 34 of the plug adapter 12, which has a larger outer periphery than a rear region 35 of the plug adapter 12. The depth of the projection 31 is essentially equal to the thickness of the side walls 29 so that in the assembled position of the plug adapter 12 there is an essentially smooth transition from the base part 11 to the plug adapter 12 and the base part 12 constitutes a homogeneous structural unit with the plug adapter 12.

As already explained, in the assembled position numerous faces on the plug adapter 12 engage corresponding face on the base part 11, as for example the side faces 18 and 19, the sides 28 and 30, the projection 31 and the end faces 32 and furthermore the guide means 20 fit into each other so that the plug adapter 12 can not, for all intents and purposes, be tilted athwart the plugging direction 15. The locking means 21 must accordingly act essentially oppositely to the plugging direction 15. It is sufficient for the present design of the plug device 10 in accordance with the invention to have only one single locking means 21. It will be clear that in principle a plurality of locking means would be possible as well, for example a second locking means could be provided on the side, which is opposite to the locking means 21, of the plug adapter 12 (not illustrated).

The locking means 21 is in the present case designed in the form of a detent locking means. In the assembled state of the plug adapter 12 a detent projection 36 on the plug adapter 12 fits into a detent recess 37 on the plug socket 17. The detent projection 36 is arranged on a resilient actuating element 38. The detent projection 36 is made oblique and wedge-like tapering toward the front side 30 of the plug adapter 12 so that on insertion of the plug projection 16 into the plug socket 17 the wedge face of the detent projection 36 slides along the top inner edge 39 of the top side wall 29 and urges the actuating element 38 toward the interior of the plug adapter 12. In the assembled state of the plug adapter 12 the actuating element 38 springs back outward 36 so that the detent projection 36 fits into the detent recess 37 plug adapter 12 is locked to the base part 11. The detent projection 36 and the detent recess 37 locks the plug adapter 12 effective in the plugging direction 15.

It will be clear that a reversed arrangement is also possible, in the case of which for example a resilient actuating element is arranged on the base part and a stationary detent recess is arranged on the plug adapter. Furthermore a plurality of detent recesses could be provided as well and there could be detent projections cooperating with them.

In the present case one actuating projection 40 of the actuating element 38 projects upward to the front of the top face of the base part 11 and, respectively, of the plug adapter 12 and may be readily operated. For unlocking the plug adapter 12 the actuating element 38 is thrust by pressing on the actuate projection 40 toward the interior of the plug adapter 12 so that the detent projection 36 is disengaged from the detent recess 37. Then the plug adapter 12 may be pulled off the base part 11 in a direction opposite to the plugging direction 15.

The actuating element 38 is designed like a resilient lug or tongue. It is pivoted for resilient movement on the front side 30 of the plug projection 16. In the present case it constitutes an integrated component of a rear housing part 41 of the plug adapter 12, which constitutes the plug projection 16.

The rear housing part 41 and furthermore preferably a front housing part 42 constituting the front part 35, of the plug adapter 12 are preferably manufactured of plastic or some other electrically insulating material. The housing parts 41 and 42 are for example joined together by bonding and/or by joint means. The front region 34 has a country specific design and is designed as a sort of country specific plug, something which will be clear on comparison with plug adapters 43 through 45 shown in FIG. 2 which are alternatives to the plug adapter 12. The rear regions 35 of the plug adapters 12, 43, 44 and 45 are essentially similar in structure, whereas the respective front regions 34, 46, 47 and 48 are different, that is to say they are country specific in design. The plug adapters 12, 43, 44 and 45 serve for country specific adaptation of the plug device 10 for line sockets in the USA, Europe, Australia and the UK.

In the case of the plug adapters 12 and 43 the polarity of the plug contacts 27 and, respectively, 49 is irrelevant. Accordingly in the case of such plug adapters 12 and 43 there is no need to ensure that they may be secured in a single, unique angular position on the base part 11. The plug adapters 12 and 43 may for example also be arranged in an opposite angular position which is turned through 180 degree on the base part, if for example, departing from the design in accordance with the working example, mutually symmetrically arranged locking means were to be provided like the locking means 21.

The case is different with the plug adapters 44 and 45, in which electrical polarity is important, at least as regards use with a country specific line socket. In this case it can be an advantage for example the plug adapters 44 and 45 only to be able to be fitted in a unique angular position on the base part 11.

The plug adapter 45 provided for the UK has, in addition to the electrically conductive plug contacts 50, which are electrically connected with the plug contacts 25 of the base part in the assembled state, a contact pin 51 which in the present case is not electrically conductive. Given a suitable electrical design of the base part 11, for example in the case of using an electrically non-insulating housing or the like, an electrical protective contact might be necessary. Then the contact pin 51 could be manufactured of electrically conductive material as for example metal and be electrically connectable by means of a plug contact (not illustrated in the figure) present in addition to the plug contacts 25.

The plug contacts 25 are in the present case proprietary electrical contacts which are not country specific. They are optimally adapted to the electrical properties of the plug device 10. In the case of such plug contacts mechanical strength is not important, since the plug adapter 12, for example owing to the nature of its housing, the guide means 20 and the like, may be connected with the base part 11 so as to resist mechanical loads. The plug contacts 25 are for example substantially thinner than country specific plug contacts for example the plug contacts 27. Moreover, they may be electrically conductive over their entire outer periphery, something which reduces the electrical resistance between the plug contacts 25 and the plug receiving sockets 26. In order to improve the electrical insulation the plug contacts 25 may be comparatively widely spaced apart, and for example as far apart as plug contacts 49 of the plug adapter 43 provided for Europe.

In addition to the already explained guide means 20 additional guide means can be provided, as for instance further guide projections 53 on the inner side faces 19 of the plug socket 17, which correspond at mating guide grooves 52 to the plug adapters 12, 43, 44 and 45. As shown in chained lines for example guide grooves 52 may be provided on the plug adapter 43.

In FIG. 2 a base part 70 is illustrated which is an alternative to the base part 11. Essentially the base part 70 is similar to the base part 11 so that functionally equivalent components have the same reference numerals. The housing of the base part 70 is smaller than the housing 60 of the base part 11. The base part 70 has a connection cable 71, with which the base part 70 may for example be connected with a mobile telephone electrically. The base part 70 comprises for example a charging adapter, with which a charging current may be provided for charging accumulators of the mobile telephone, not illustrated.

It will be clear that other housing configurations are possible besides the configuration of the base parts 11 and 70, as for instance cylindrical or barrel-like housing forms.

The invention claimed is:

1. A plug device for plugging into a country specific electrical plug receiving socket comprising a base part having first plug contacts and at least one country specific electrical plug adapter, engageable to the base part, the base part having a plug socket for engagement with a plug projection of the plug adaptor;

wherein a flat end and flat sides of the plug projection respectively abut against a flat bottom and flat sides of the plug socket, the plug projection of the plug adapter having plug receiving sockets into which the first plug contacts can be correspondingly engaged thereto and second country specific plug contacts for corresponding engagement into the country specific plug socket;

a length of the first plug contacts being parallel to that of the second country specific plug contacts, the first plug contacts each having a cross-sectional area substantially smaller than that of the second country specific contacts;

wherein the at least one plug adapter may be locked in the base part without using a tool in a mounted position using locking apparatus and may be detached from the base part after unlocking the locking apparatus;

the locking apparatus having a resilient actuating element fixed to the end of the plug projection of the plug adapter with a free end extending back toward an end of the plug adapter opposite to the end of the plug projection, and at least one detent projection on the actuating element for fitting into a detent recess on an inner side of a wall forming the plug socket of the base or alternatively the detent recess being on the actuating element and the projection being on the inner side of the wall;

wherein the at least one detent projection or detent recess is positioned on the resilient actuating element between an end of the actuating element fixed to the end of the plug projection and the free end of the resilient actuating element; and wherein when the base part and plug adaptor are locked together, the free end of the resilient actuating element projects out from under the inner side of the wall forming the plug socket and up from the plug adapter to permit release of the locking apparatus when the free end is pressed down away from the inner side of the wall.

2. The plug device as set forth in claim 1, wherein the at least one plug adapter is adapted to be connected with the base part by plugging.

3. The plug device as set forth in claim 1, wherein in the assembled state the plug adapter is essentially unable to be tilted athwart the insertion direction.

4. The plug device as set forth in claim 1, wherein the at least one plug adapter is able to be arranged in a unique predetermined angular position against connection with the wrong polarity.

5. The plug device as set forth in claim 1, wherein the at least one plug adapter is able to be arranged in at least two predetermined angular positions on the base part.

6. The plug device as set forth in claim 1, wherein the base part comprises an electrical device and more especially a electric lamp and/or an electrical power pack and/or a charging device for accumulators and/or a transformer and/or an inverter and/or a rectifier and/or an electrical adaptation device.

7. The plug device as set forth in claim 1, wherein the first plug contacts are perpendicular to the flat bottom of the plug socket of the base part.

8. The plug device as set forth in claim 1, wherein the plug projection is completely fitted into the plug socket.

9. The plug device as set forth in claim 1, wherein the plug projection (16) has a rectangular outline or a circular outline or a elliptical outline and the plug socket (17) has a corresponding inner shape.

10. The plug device as set forth in claim 1, wherein a bottom inner face (54) of the plug socket comprises a guide projection (24), which fits into a guide groove (22) on a bottom side face (23) of the plug projection (16).

11. The plug device as set forth in claim 1, wherein adjacent to the plug socket of the base part first plug contacts are provided, which do not project past the plug socket and which in the fitted position fit into the plug receiving sockets on the at least one plug adapter.

12. The plug device as set forth in claim 11, wherein the first plug contacts are proprietary plug contacts not provided for country specific plugs.

13. The plug device as set forth in claim 1, comprising on the plug socket at least one guide means for angular guided fitting of the plug adapter into the mounted position.

14. The plug device as set forth in claim 13, wherein the at least one guide means entails guidance of the plug adapter on insertion into the plug socket even prior to fitting of the first plug contacts into the plug receiving sockets on the at least one plug adapter in a predetermined angular setting so that the plug contact are opposite to the plug receiving sockets and may fit into same.

15. The plug device as set forth in claim 1, wherein the plug adapter (12) has a lateral projection (31) that in the assembled state engages terminal sides (32) of side walls (29) of the plug socket (17) over a flat area.

16. The plug device as set forth in claim 15, wherein the lateral projection (31) is collar-shaped.

17. The plug device as set forth in claim 15, wherein the thickness of the side walls (29) and the depth of the projection (31) are essentially equal, so that in the assembled position of the plug adapter (12) there is an essentially smooth transition from the base part (12) to the plug adapter (12).

* * * * *